US005540386A

United States Patent [19]

Roman

[11] Patent Number: 5,540,386

[45] Date of Patent: Jul. 30, 1996

[54] MULTIFUNCTION DELIVERY UNIT FOR IRRIGATION PISTOL

[75] Inventor: Gianfranco Roman, Pasiano, Italy

[73] Assignee: Claber, S.P.A., Italy

[21] Appl. No.: 343,924

[22] Filed: Nov. 17, 1994

[30] Foreign Application Priority Data

Nov. 23, 1993 [IT] Italy ..... MI93U0908 U

[51] Int. Cl.[6] ..... B05B 1/16

[52] U.S. Cl. ..... 239/394

[58] Field of Search ..... 239/394, 390–392

[56] References Cited

U.S. PATENT DOCUMENTS

| | | | |
|---|---|---|---|
| Re. 30,350 | 7/1980 | Peterson et al. | 239/394 |
| 4,043,511 | 8/1977 | Nakamura | 239/394 |
| 4,094,468 | 6/1978 | Volle | 239/394 |
| 4,448,355 | 5/1984 | Roman | 239/526 |
| 4,666,085 | 5/1987 | Liaw | 239/394 |
| 4,903,897 | 2/1990 | Hayes | 239/394 |
| 5,232,162 | 8/1993 | Chih | 239/394 |

FOREIGN PATENT DOCUMENTS

| | | |
|---|---|---|
| A2476506 | 8/1971 | France . |
| 2136710 | 9/1984 | United Kingdom . |

*Primary Examiner*—Karen B. Merritt
*Attorney, Agent, or Firm*—Nixon & Vanderhye

[57] ABSTRACT

A multifunction delivery unit for an irrigation pistol comprises a supporting casing that can be fastened to one end of a delivery pipe of the pistol with a diffusion passage of the casing placed in front of a delivery nozzle obtained at the end of the pipe. A spray selector that supports a plurality of delivery elements suitable for delivering sprays of different shapes is mounted rotatably on the supporting casing so that it can be rotated in order to position a selected delivery element at the outlet from the diffusion.

9 Claims, 5 Drawing Sheets

MULTIFUNCTION DELIVERY UNIT FOR IRRIGATION PISTOL

BACKGROUND

1. Field of Invention

The present invention relates to a multifunction delivery unit for an irrigation pistol.

2. Related Art and Other Considerations

Irrigation pistols typically comprise a delivery pipe connected to a hollow handgrip through which the irrigation liquid arrives.

The delivery pipe ends at the front with a mouth at the center of which there is a nozzle for delivering the irrigation liquid.

Inside the delivery pipe there is a mobile member for opening and closing the nozzle, which member is operated from the outside by means of suitable operating levers.

The regulation of the flow of liquid is obtained by operating the member for opening and closing the nozzle.

A similar pistol is described in the U.S. Pat. No. 4,448,355. The spray delivered by this pistol, however, has a substantially circular shape, with a surface that is larger or smaller in relation to the degree by which the nozzle is open.

Irrigation pistols are also known on whose delivery mouth it is possible to manually fit delivery members that are interchangeable one with the other and that are suitable for obtaining sprays with a shape other than circular, for example like a fan or a sprinkle, so as to allow the use of the pistol in various situations.

To change an irrigation member the user must, however, proceed to dismantle it manually from the mouth of the pistol and subsequently mount a different irrigation element.

In view of the described state of the art, the object of the present invention is to provide an irrigation pistol wherein it is possible to vary the shape of the delivered spray without having to proceed to the replacement by means of dismantling the spray's delivery elements.

SUMMARY

Such object is attained by a multifunction delivery unit for an irrigation pistol according to the present invention. The delivery unit comprising a delivery pipe of a spray of liquid provided at one end with a delivery nozzle having a controlled opening. A supporting casing can be fastened to said end of the delivery pipe of the pistol with a diffusion passage of the spray placed in front of said nozzle. A spray selector supports a plurality of delivery elements suitable for delivering sprays of different shapes and is mounted rotatably on said supporting casing so that it can be rotated in order to position a delivery element (selected as the case may be) at the outlet from said passage. Means are provided for holding said selector in the position (selected as the case may be).

Thanks to the present invention, it is possible to provide an irrigation pistol wherein the shape of the spray can be varied by the user himself, simply by positioning the desired delivery element in front of the nozzle of the pipe of the pistol, without dismantling any element of the pistol itself.

BRIEF DESCRIPTION OF THE DRAWINGS

These and other features of the present invention will be made more evident by the following detailed description of two embodiments thereof, illustrated as non-limiting examples in the enclosed drawings, wherein.

DETAILED DESCRIPTION OF THE DRAWINGS

Figure 1:
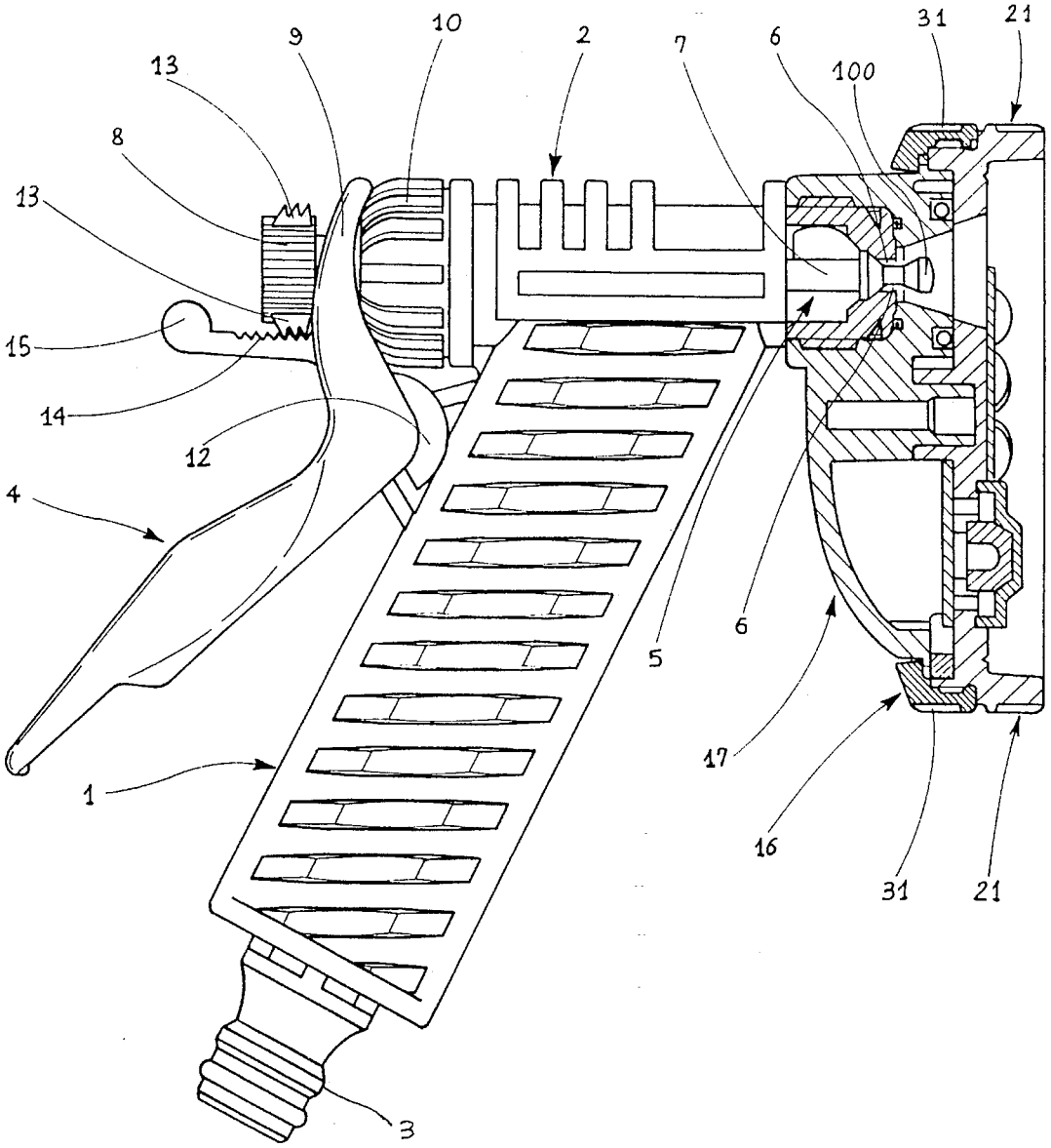
FIG. 1 shows a partially-sectioned lateral view of a pistol according to a first embodiment of the invention.

As shown in FIG. 1, an irrigation pistol comprises a hollow handgrip 1 connected to a delivery pipe 2.

At the base of the handgrip 1 there is a coupling 3 for connecting to a supply pipe of the irrigation liquid, not shown in the drawings.

At one end of the delivery pipe 2 there is a trigger 4 that operates an opening and closing member 5 of a circular nozzle 6 placed at the other end of the delivery pipe 2. The opening and closing member 5 is constituted by a rod 7 inside the pipe 2 and that is provided at one end with a plug 100 for the nozzle 6, while at the other end it has a head 8 that engages with trigger 4. The latter is provided in its upper part with an opening, through which the rod 7 passes, that forms two lateral arms 9 that are joined at their upper ends, so that head 8 presses on said arms 9 due to the effect of a spring, not shown, contained in the delivery pipe 2. The two arms 9 in turn press on the rear end of the pipe 2 that is closed by a ring nut 10.

The trigger 4 is hinged on the handgrip 1 thanks to a pivot (not visible) made integral with the trigger 4 and slot-fastened to a semicircular seat defined by a protrusion 12 of the handgrip 1. The head 8 of the opening and closing member 5 has sets of lateral notches 13 suitable for meshing with a complementary set of notches 14 provided on a flexible portion 15 that passes through the opening of the trigger 4 and is fastened to one end on said protrusion 12 on said pivot.

Figure 2:
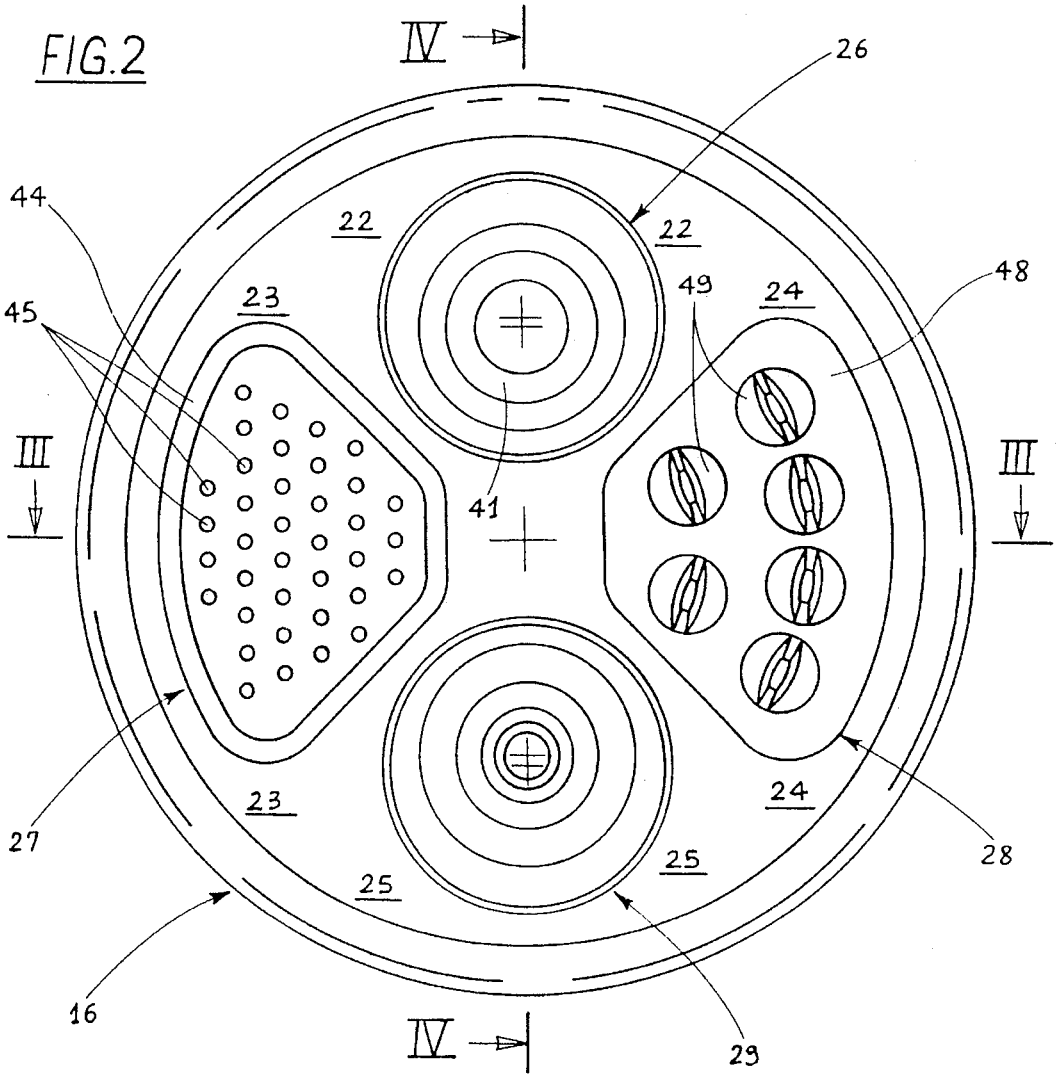
FIG. 2 shows a front view of the detail of a delivery unit of the pistol of FIG. 1.
Figure 3:
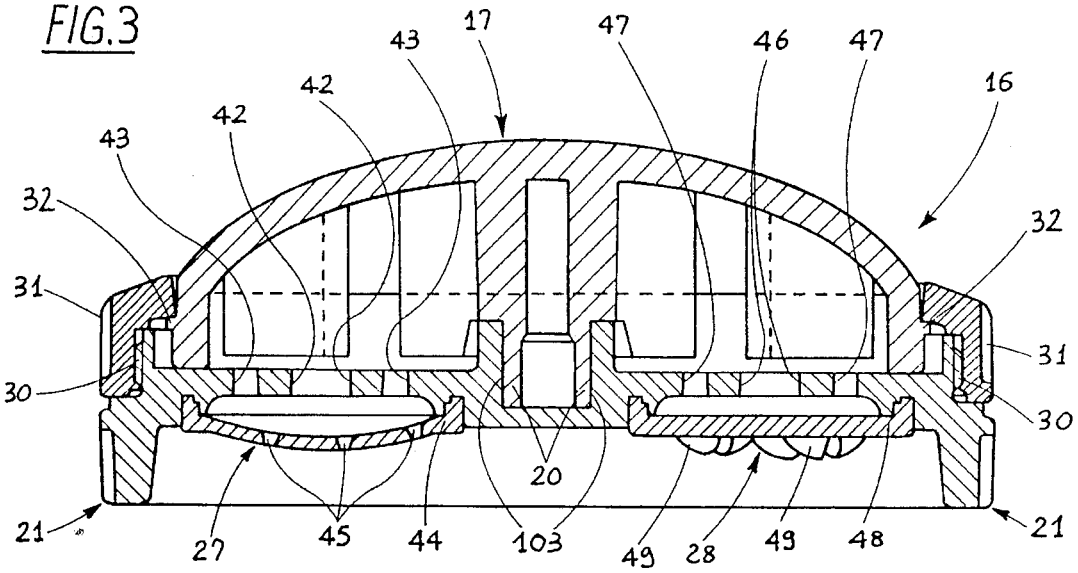
FIG. 3 is a cross-sectional view taken along the line III—III of FIG. 2.
Figure 4:
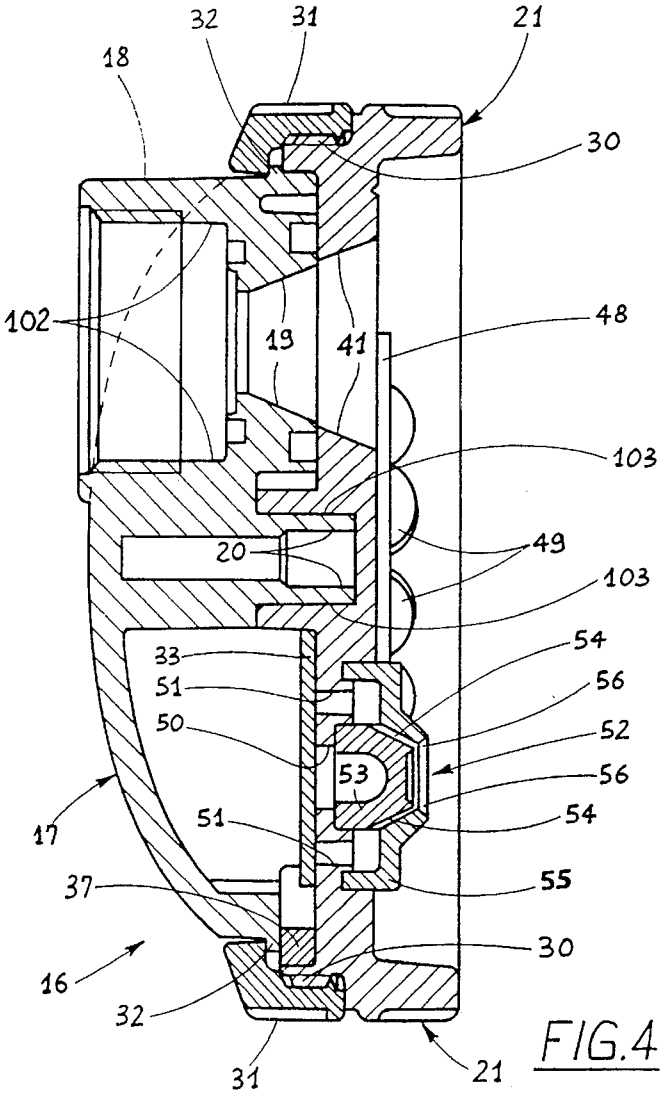
FIG. 4 is a cross-sectional view taken along the line IV—IV of FIG. 2.

The delivery pipe 2 ends at the front with a threaded portion on which a delivery unit 16 is fastened by screwing, shown in an enlarged scale in FIGS. 2–4.

Figure 8:
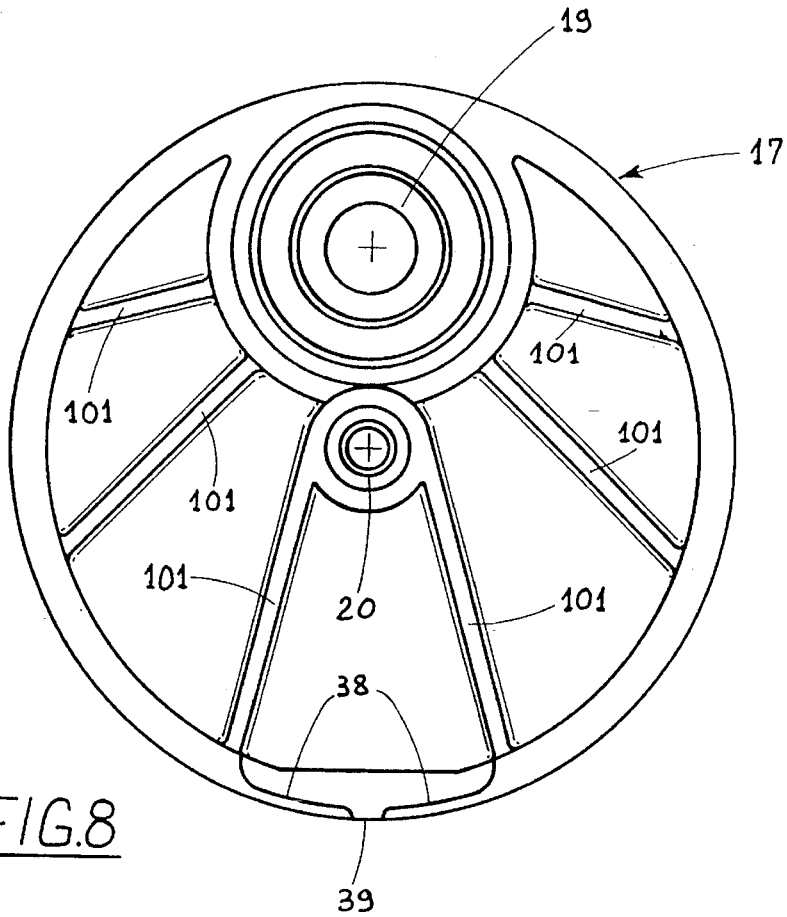
FIG. 8 is a front view of a second piece constituting the delivery unit.

The delivery unit 16 consists of a support casing 17 in plastic material having essentially the shape of a spherical cap with reinforcing ribs 101 (FIG. 8). The support casing 17 at the rear has a hollow cylindrical appendix 18 threaded on the inside, thanks to which the casing 17 can be screwed onto the threaded portion of the delivery pipe 2 to make it integral with the handgrip 1 of the pistol. The hollow cavity 102 inside the cylindrical appendix 18 ends at the front with a hole that, once the support casing 17 has been mounted on the pipe 2, faces the nozzle 6 located at the end of the pipe 2 itself. In front of said hole there is a trumpet-shaped tapered cavity 19 constituting a diffusion passage of the liquid spray. The support casing 17 is also provided at the front and in a central position with a hub 20.

Figure 6:
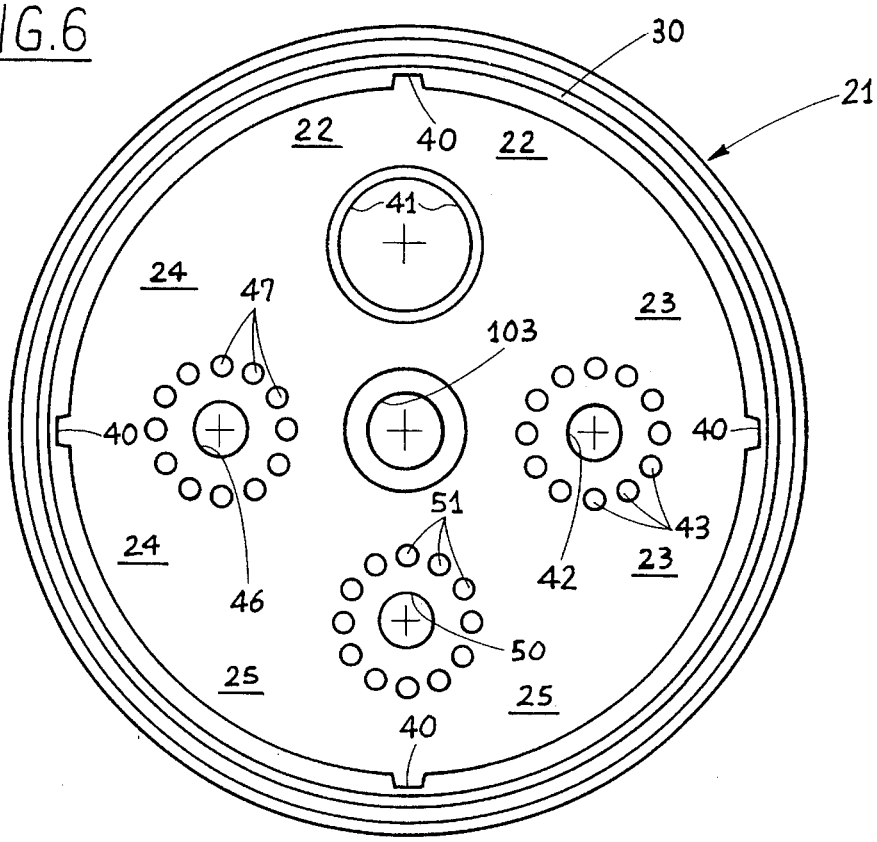
FIG. 6 is a rear view of a first piece constituting said delivery unit.
Figure 7:
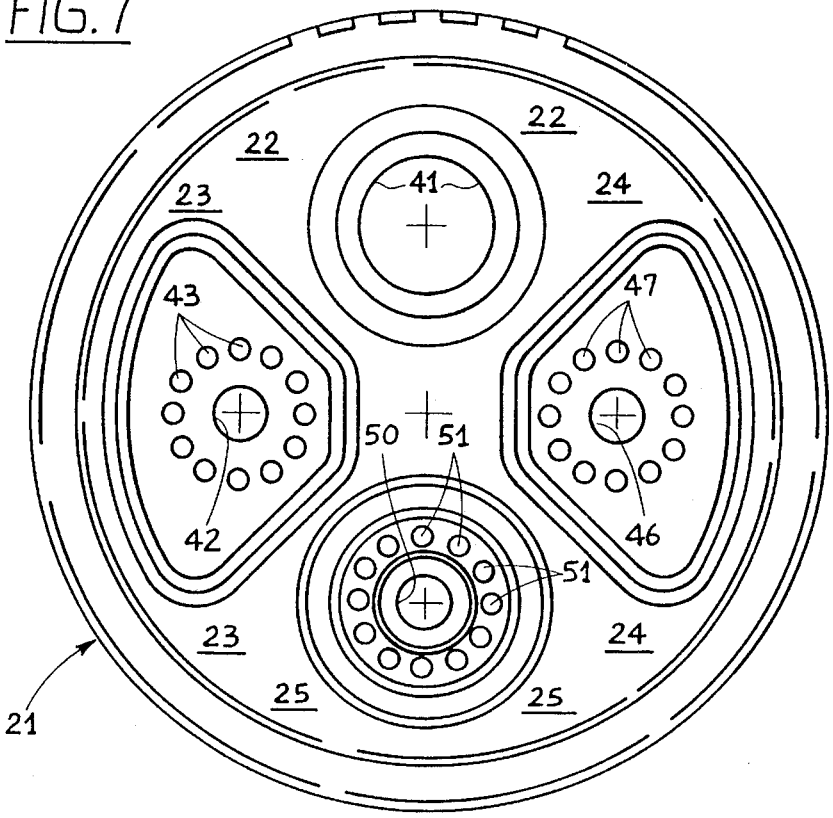
FIG. 7 is a front view of the piece of FIG. 6.

At the front of the support casing 17 there is mounted in a rotatable manner on the hub 20 a spray selector constituted by a circular flange 21 in plastic material provided with a central blank hole 103. Flange 21 is ideally divided into four quadrants 22–25 corresponding to as many delivery elements 26–29 with different characteristics of the spray that can be delivered (FIGS. 2, 6 and 7). The flange 21 has a thread 30 on the outside, on which a ring nut 31 is screwed, forming an abutment against a contrasting circular rib 32 provided on the support casing 17. Nut 31 prevents the flange 21 from being dismantled from the support casing 17, but allows the relative rotation of the flange 21 with respect to the support casing 17 round the hub 20.

Figure 9:
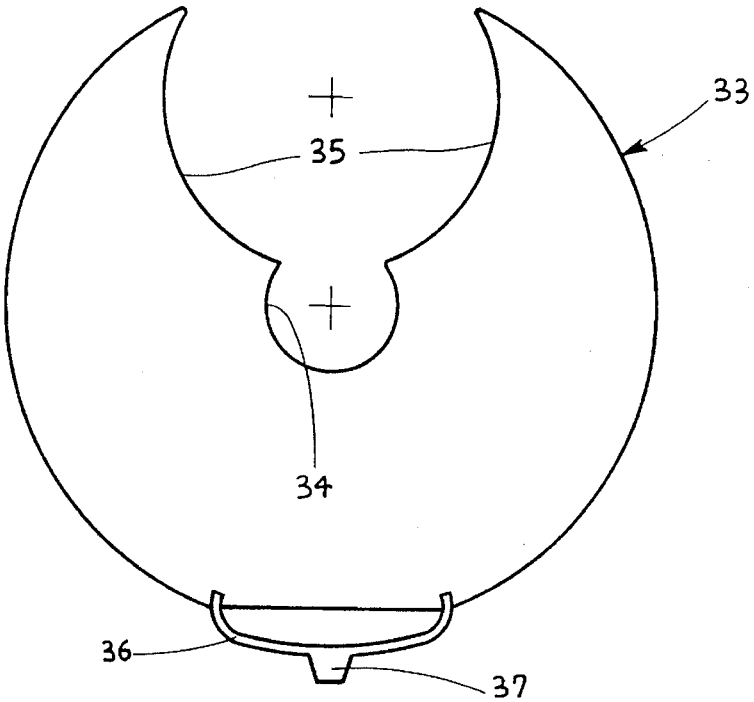
FIG. 9 is a front view of a third piece constituting the delivery unit.

Interposed between the front surface of the support casing 17 and the circular flange 21 there is a disc 33 (FIG. 9). Disc 33 is also in plastic material, and is provided with a central hole 34 for the passage of the hub 20 and with an upper opening 35. Opening 35 communicate with said hole 34, so that the disc 33, once it is mounted on the support casing 17, does not obstruct the outlet of the tapered cavity 19. The disc has an elastic tang 36 in its lower part that is integral with the disc 33 and ends with a pawl 37. When the disc 33 is mounted on the casing 17, the tang 36 is housed inside a slot 38, and the pawl 37 protrudes below the edge 39 of the support casing 17. The flange 21 is also provided with four notches 40 placed in a circumferential succession according to orthogonal directions corresponding to the central axis of each of the four quadrants 22–25 into which the flange 21 itself is ideally divided. Each of such notches 40 can house the end of the pawl 37 protruding from the edge 39 of the support casing 17. The rotation of the flange 21 on the hub 20 is made possible by the inward deflection of the tang 36 that determines the disengagement of the end of the pawl 37 from a notch 40, while the engagement of the pawl 37 inside one of the notches 40 allows the flange 21 to be locked in one of four different angular positions, in each of which one of the four delivery members 26–29 is in front of the outlet of the tapered cavity 19.

A first delivery element 26, obtained in a first quadrant 22 of the flange 21, is essentially constituted by a trumpet-shaped tapered cavity 41, obtained in the flange 21. When the flange 21 is rotated as shown in FIG. 4, delivery element 26 is exactly in front of the outlet of the tapered cavity 19 provided in the support casing 17. The spray delivered in this way has a circular cross-section, and the pistol behaves like a normal nozzle.

A second delivery element 27, visible in FIGS. 2, 3, 6 and 7, obtained in a second quadrant 23 of the flange 21, comprises a central hole 42 and a circumferential succession of holes 43 with a smaller diameter, said succession being concentric with the central hole 42. In front of the flange 21, at said second quadrant, there is an element 44 in the shape of a circular crown in which several holes 45 with a very small diameter are made. When the flange 21 is rotated so that the delivery member 27 is in front of the outlet of the tapered cavity 19 of the support casing 17, the pistol delivers a sprinkle-like spray. The spray obtained in this way can for example be used to irrigate trees of a small size.

A third delivery element 28, obtained in a third quadrant 24 of the flange 21, also comprises a central hole 46 and a circumferential succession of holes 47 with a smaller diameter, concentric with the central hole 46. In front of the flange 21, at said third quadrant 24, there is a further element 48 in the shape of a sector of a circular crown that is, however, provided with a plurality of nozzles 49 suitable for determining as many fan-like sprays, when the flange 21 is rotated so that the delivery member 28 is in front of the outlet of the tapered cavity 19 of the support casing 17. The spray that is obtained is for example useful for the irrigation of trees of a large size.

A fourth delivery member 29, obtained in a fourth quadrant 25 of the flange 21, comprises, like the two previous ones, a central hole 50 surrounded by a circumferential succession of holes 51 with a smaller diameter, concentric with the central hole 50. In front of the flange 21, at said fourth quadrant, there is a vaporizer 52 comprising a frustum-shaped element 53, on the external surface of which there are grooves 54 in a number identical to the number of holes 51, and a conveyor 55 provided with a central tapered hole 56 having a diameter coincident with the diameter of the smaller base of the frustum-shaped element 53. Grooves 54 have a depth that decreases in the outward direction. When the flange 21 is rotated so that the fourth delivery element 29 is in front of the outlet of the tapered cavity 19 of the casing 17, the irrigation liquid flows through the holes 51 and is channelled along the grooves 54, that are closed above by the conveyor 55. The spray coming out of the central hole 56 of the conveyor is constituted by a fine rain of droplets, useful (for example) for washing leaves.

In order to use the irrigation pistol, it should first be connected by means of a hose to a water-delivery point.

By operating the trigger 4 it is possible to adjust the delivery of irrigation liquid through the nozzle 6, and thus the intensity of the spray produced by the pistol. The sets of notches 13 and 14, meshing reciprocally, allow the trigger 4 to be locked into a desired position. To release, it is sufficient to lower the flexible portion 15, so that the set of notches 14 can be released from the set of notches 13.

The shape of the spray delivered by the pistol can be varied, even without interrupting the spray itself, simply by slightly loosening the ring nut 31 and rotating the flange 21 by hand. When a suitable torque is applied to the flange 21, the tang 36 is deflected inwardly and lifts the pawl 37 that is then released from the notch 40 in which it was housed. The flange is thus rotated by multiples of 90°, until the selected delivery element gets to be in front of the outlet of the tapered cavity 19. That the correct position has been reached is highlighted by the fact that the pawl 37 drops into a respective notch 40.

Figure 5:
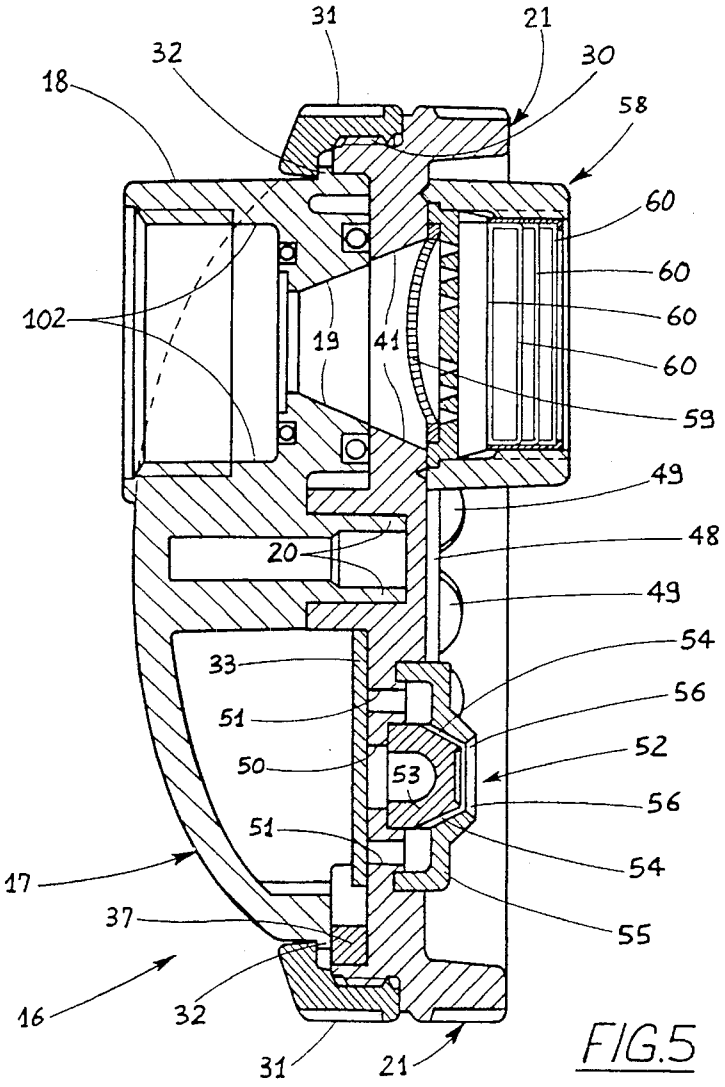
FIG. 5 is similar to FIG. 4, but it refers to a second embodiment of the present invention.

In a second embodiment of the invention, shown in FIG. 5, in front of the flange 21, at the first quadrant 22, there is applied a spray-breaking or pearling element 58 comprising a net filter 59 in plastic material, and one or more metal nets 60. In this way a spray is obtained suitable for irrigating trees from a close-up position, or in a pot.

In fact said pearling member 58 allows the formation of air pearls inside the water spray; a spray is thus obtained that does not bounce back even if an obstacle is encountered, even at a distance of a few centimeters.

I claim:

1. A multifunction delivery unit for an irrigation pistol, the irrigation pistol having a delivery pipe for a spray of liquid, the delivery pipe being provided at one end with a delivery nozzle having a controlled opening, the delivery unit comprising:

a supporting casing that can be fastened to said end of the delivery pipe of the pistol with a diffusion passage of the casing situated in front of said nozzle, a spray selector that supports a plurality of delivery elements suitable for delivering sprays of different shapes and that is mounted rotatably on said supporting casing so that it can be rotated to a selected position whereat a selected delivery element is positioned at an outlet from said passage, and means for holding said selector in the selected position, the means for holding said selector in the selected position comprising an elastic tang forming part of an element interposed between said selector and the supporting casing, said tang having a protruding pawl that can be inserted in respective seats with which the selector is provided at each delivery element.

2. Unit according to claim 1, characterized in that said selector has a circular shape, each delivery element being located in a different sector of said selector.

3. Unit according to claim 2, characterized in that said plurality of delivery elements comprises four delivery elements located in four quadrants of said selector.

4. Unit according to claim 3, characterized in that the plurality of delivery elements comprises a first delivery element, located in a first quadrant, comprising a tapered cavity in said selector to obtain a spray having a circular cross-section.

5. Unit according to claim 4, characterized in that said first delivery element also comprises an element constituted by a plurality of net filters, positioned at an outlet of said tapered cavity and having the function of a spray-breaker.

6. Unit according to claim 3, characterized in that the plurality of delivery elements comprises a second delivery element, located in a second quadrant, comprising a plurality of holes so as to convey the liquid toward a first diffuser provided with a plurality of holes having a diameter smaller than the previous ones so as to obtain a sprinkle-type spray.

7. Unit according to claim 3, characterized in that the plurality of delivery elements comprises a third delivery element, located in a third quadrant, comprising a plurality of holes so as to convey the liquid toward a second diffuser provided with a plurality of nozzles which each produce a fan-shaped spray.

8. Unit according to claim 3, characterized in that the plurality of delivery elements comprises a fourth delivery element, located in a fourth quadrant, comprising a plurality of holes so as to convey the liquid toward a vaporizer.

9. Unit according to claim 8, characterized in that said vaporizer comprises a frustum-shaped element provided on its external surface with grooves having a decreasing depth placed at the outlet of said plurality of holes, and a conveyor mounted on said frustum-shaped element in order to convey the liquid issuing from said plurality of holes inside said grooves and provided with a central hole for the diffusion of the liquid.

* * * * *